US005619943A

United States Patent [19]

Kieronski

[11] Patent Number: 5,619,943

[45] Date of Patent: Apr. 15, 1997

[54] PORTABLE WATERCRAFT WITH IMPROVED PONTOON CONNECTION

[76] Inventor: Robert V. Kieronski, 37 Catherine St., Newport, R.I. 02840

[21] Appl. No.: 628,310

[22] Filed: Apr. 5, 1996

[51] Int. Cl.[6] ..... B63B 1/00

[52] U.S. Cl. ..... 114/61; 114/352

[58] Field of Search ..... 114/61, 123, 352, 114/353, 354, 282, 283, 292; 403/52, 83, 88, 100, 105, 110

[56] References Cited

U.S. PATENT DOCUMENTS

| | | | |
|---|---|---|---|
| D. 305,637 | 1/1990 | Emmer | D12/304 |
| 3,524,422 | 8/1970 | Fuller | 114/61 |
| 4,271,549 | 6/1981 | Chandler | 9/2 S |
| 4,582,012 | 4/1986 | Montgomery | 114/61 |
| 4,724,785 | 2/1988 | Van Hauwaert | 114/61 |
| 4,782,777 | 11/1988 | Sussman | 114/39.1 |
| 4,829,926 | 5/1989 | Voelkel | 114/61 |
| 4,915,047 | 4/1990 | Lord et al. | 114/39.1 |

*Primary Examiner*—Stephen Avila
*Attorney, Agent, or Firm*—Barlow & Barlow, Ltd.

[57] ABSTRACT

A portable watercraft having an improved cross-arm to pontoon connection is shown. The pontoon includes an attachment pad with a handle provided thereon which serves as the male portion of the connection. A cross-arm, with a downwardly curved free end, includes an aperture therein to serve as the female portion of the connection. A strap is connected to the cross-arm and routed through a strap aperture for routing through the handle and back through the strap aperture for securement to the cross-arm by a fastener. As a result, a cross-arm may be quickly and easily releasably secured to a pontoon to permit fast assembly and disassembly for ease of transport.

7 Claims, 5 Drawing Sheets

PORTABLE WATERCRAFT WITH IMPROVED PONTOON CONNECTION

BACKGROUND OF THE INVENTION

The present invention relates generally to a portable watercraft. More specifically, the present invention relates to a portable watercraft which can be easily assembled and disassembled by use of a quick-release pontoon connection.

In the field of portable watercraft, namely sculls, it has been well-known to employ a pair of flotation members or pontoons, a frame assembly mounted to the floatation members, a sliding seat and a pair of oars pivotally connected to the frame assembly. Such a watercraft is typically removed from the water between uses and transported by the user. As a result, the portability and assembly of these types of watercraft are of critical importance. As can be understood, it is desirable to have a watercraft which is small enough or small enough after disassembly to fit easily on a roof of a car or truck without the need for an additional boat trailer. To further facilitate transport, it is desirable that the watercraft be lightweight and quick and easy to assembly without the need for complex tools. Therefore, the particular assembly and connection method for assembling the various parts of the watercraft must be easy and simple to operate yet still providing a secure and safe connection.

Various attempts have been made in the prior art to provide a portable watercraft which is easily transportable, lightweight and easy to assemble. For example, U.S. Pat. No. 3,524,422, issued to Richard Buckminster Fuller, incorporated herein by reference, discloses a catamaran-style rowing watercraft with a sliding seat and long oars where the entire assembly includes lateral and transverse support elements positioned on two float members positioned parallel to one another. In view of the low center of gravity in positioning of the pontoons, the watercraft is stable while being lightweight and easily transportable.

In addition, U.S. Pat. No. 4,915,047, issued to Lord et al., incorporated herein by reference, discloses a knock-down catamaran with inflatable pontoons to facilitate disassembly of the watercraft. The frame includes longitudinal members which are releasably connected to the transverse members. The pontoons are individually inflatable and are releasably connected to the frame members of the catamaran boat. Further, U.S. Pat. No. 4,829,926, issued to Voelkel, incorporated herein by reference, discloses a pontoon boat having a collapsible form to facilitate transport and disassembly. In particular, each pontoon is constructed of two end-to-end floatation structures which are folded to result in a compact structure for transport. Two identical collapsible platform frames have pin and socket connections for interlinking with the pontoon and have a removable floor plate which rests in a hinged bottom support frame. As a result, the pontoon boat may be easily transported after disassembly.

The various prior art watercraft have attempted a solution to the aforementioned field assembly of waterborne vessels. These prior art solutions rely on inferior connection and assembly structures and do not specifically address concern regarding compact stacking of components for storage, transport of the disassembled components as well as weight concerns for mailing. Further, prior art watercraft of this kind require too many components which result in a watercraft which is exceedingly costly.

Due to the demand for an inexpensive portable watercraft, it is desirable for a portable watercraft to be easily disassembled and assembled, with few component parts where the parts are standard and readily available to keep the overall cost of the watercraft down. It is particularly desirable to include a connection system for assembling various components of the watercraft together which is simple to use while providing a secure and safe connection.

SUMMARY OF THE INVENTION

The present invention preserves the advantages of prior art portable watercraft which can be disassembled for transport. In addition, it provides new advantages not found in currently available portable watercraft, and overcomes many disadvantages of such currently available portable watercraft. The invention is generally directed to a novel and unique portable watercraft with a unique pontoon connection system. The portable watercraft of the present invention enables the simple, easy and inexpensive assembly, use, and maintenance of a portable watercraft while providing a superior performance watercraft which can be easily disassembled into a compact form to facilitate transport.

The preferred embodiment of the present invention includes four primary members. A pair of pontoon members, which are spaced apart and parallel to one another, are provided. Mounted on the pontoons is a frame assembly including at least two cross-arms where the cross-arms span between the two pontoons. Mounted on the frame assembly is a sliding seat for accommodating a user. Further, a pair of oars are pivotally connected to the frame assembly for propelling the watercraft. Alternatively, a lightweight motor or pedal powered assembly may be affixed to the frame for propulsion.

In addition, the cross-arms of the frame assembly are connected to the pontoon members with an improved connection structure. A mounting pad is provided on the pontoon in the appropriate desired position. A handle is connected to the mounting pad. Each cross-arm includes a central support region and two connector regions on opposing sides thereof. The connector regions are tapered downwardly approximately 90° relative to the central support region. The connector regions each include an inner wall and an outer wall to define a handle aperture. A strap is provided with an anchor end and a free end. The anchor end of the strap is connected to the central support region of the cross-arm proximal to the connector region. A fastener for securing the free end of the strap in relation to the cross-arm is also provided. The fastener is positioned on the central support region proximal to the anchor end of the strap. In addition, a strap aperture is provided in the outer wall of the connector region for receiving the free end of the strap therethrough.

In the assembly process, namely the connection of a cross-arm to a pontoon, the cross-arm is mated to the pontoon so the connector region embraces the handle connected to the mounting pad. As a result, the handle connected to the pontoon will reside completely within the handle aperture defined by the inner wall and outer wall of the connector region. The strap is then routed through the strap aperture and then between the handle and the mounting pad. The strap is then routed through the strap aperture again to expose the free end of the strap. The free end of the strap is routed to the fastener for securement. Preferably, a cam-latch fastener is employed to permit adjustment of the strap tension. As a result, the cross-arm is safely secured to the pontoon via its handle which may also be used to carry the pontoon during transport.

in particular, the improved cross-arm to pontoon connection enables easy assembly and disassembly in the field for ease of transport. This new design is self aligning, tolerant of moderate amounts of sand and grit and includes no sharp projections which could cause injury. The employment of the pontoon handle as the male portion of the fastening structure enables a superior connection without breaching the integrity of the water-tight pontoon hull.

It is therefore an object of the present invention to provide a portable watercraft rowing vessel which disassembles to half its assembled length and which can be easily assembled in the field by one person.

Another object of the present invention is to provide a portable watercraft which is lightweight yet maintains a strong self-aligning connection which is not dependent on a close tolerance fitting.

It is a further object of the present invention to provide a pontoon connection structure which utilizes soft, conforming components to maximize simplicity and minimize the chance of injury to a user.

It is yet a further object of the present invention to provide a portable watercraft with a pontoon connection which employs the handle of the pontoon which is also employed for manipulating the pontoon sections during assembly.

It is another object of the present invention to provide a portable watercraft which includes an improved pontoon connection assembly which is self-aligning with few parts to reduce the overall cost of the watercraft.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
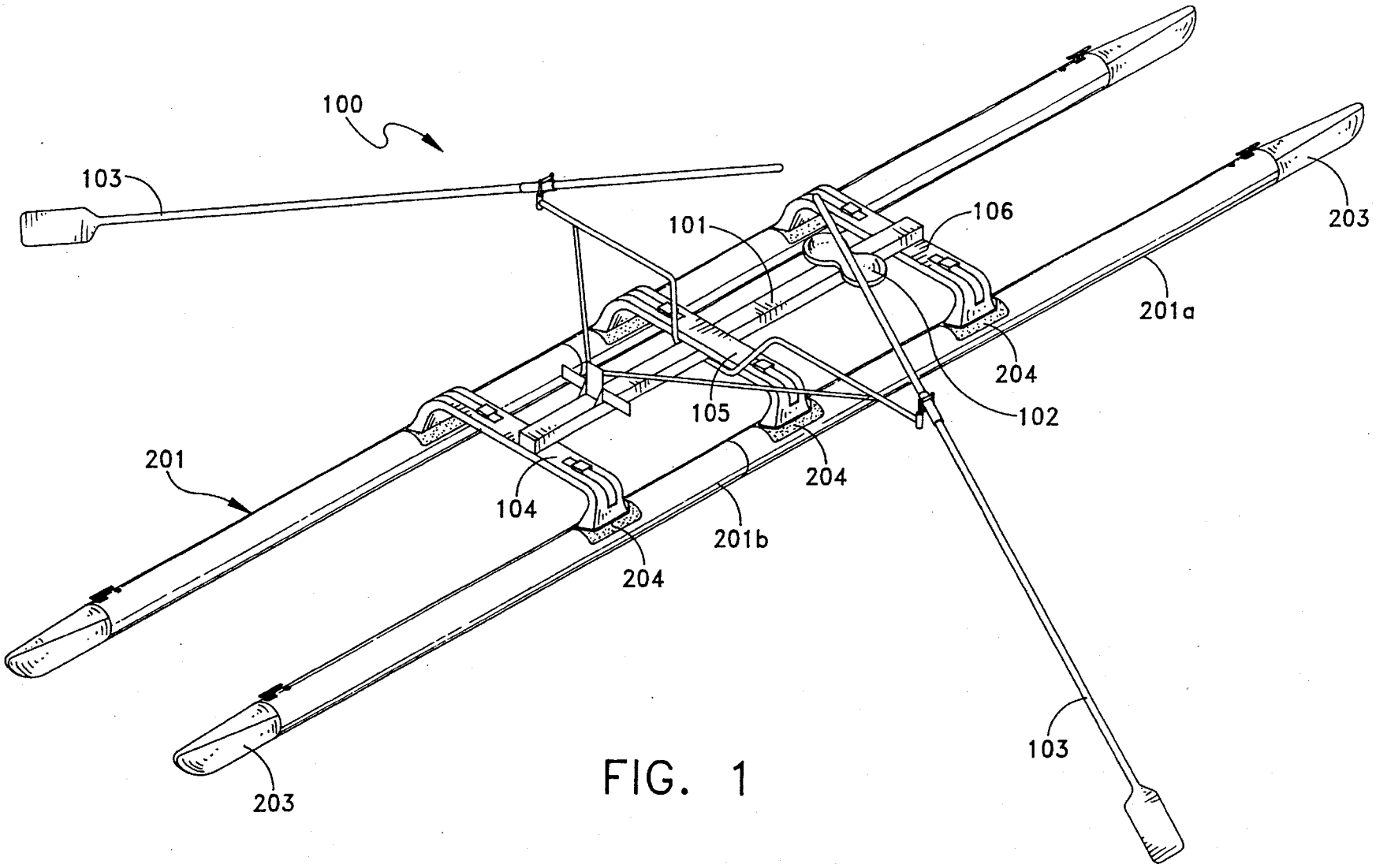
FIG. 1 is a perspective view of the assembled portable watercraft of the present invention.

Referring to FIG. 1, a pontoon watercraft 100 of the present invention is generally shown to include a frame 101 with a sliding seat 102 and outrigged oars 103. A pair of pontoons 201 are joined by cross-arms 104, 105 and 106. As will be described in detail below, the cross-arms are uniquely designed to quickly and easily affix to pontoons 201, in releasable fashion, without the use of complicated screws, pins or rivets.

Figure 2:
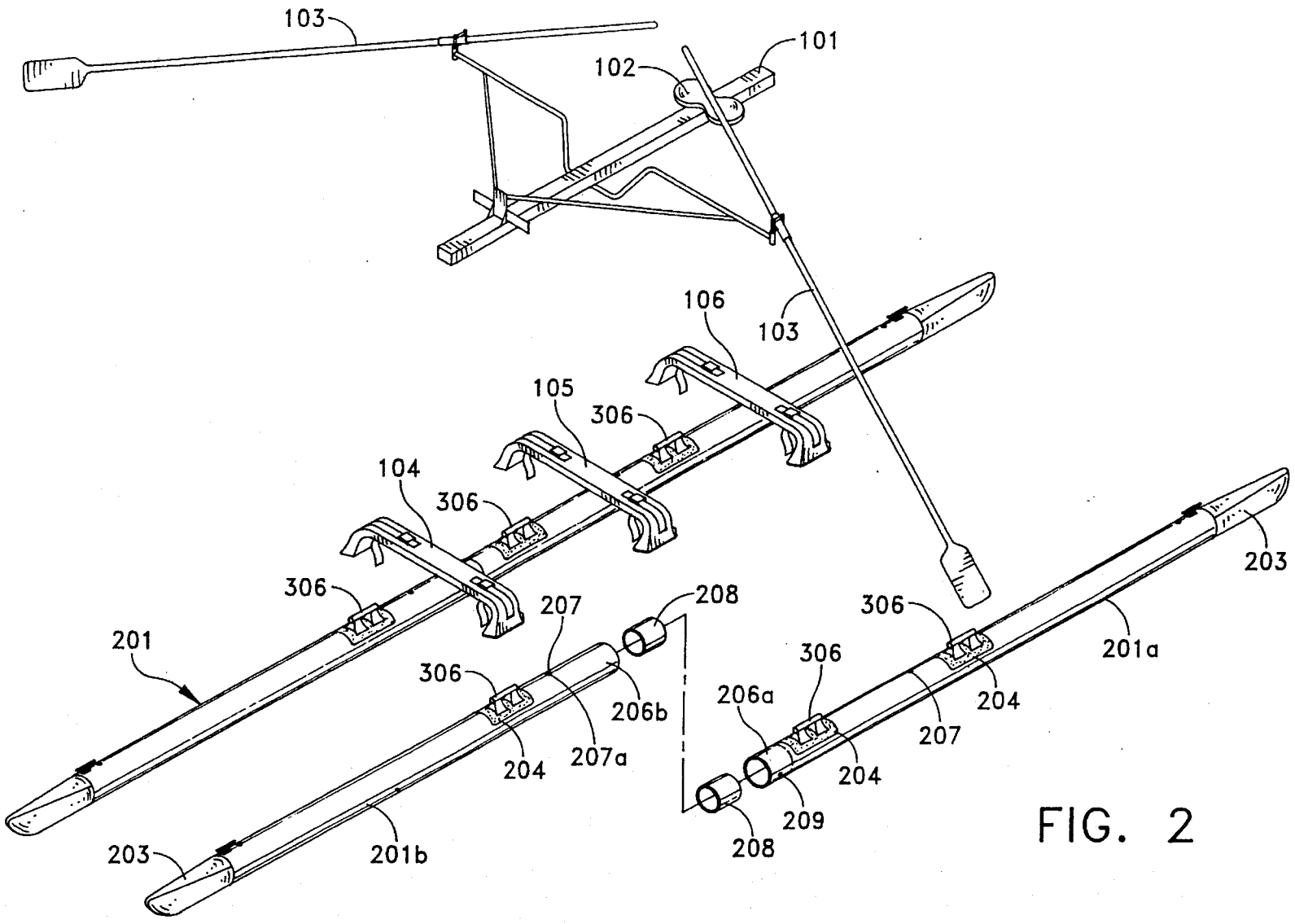
FIG. 2 is an exploded view of the portable watercraft of FIG. 1.

Still referring to FIG. 1 and further referring to FIG. 2, an exploded view of FIG. 1, the watercraft of the present invention is shown. A pair of pontoons 201 are provided which are preferably broken up into subsections 201*a* and 201*b* for ease of compact transport. Frame 101, with sliding seat 102 and oars 103, is affixed to cross-arms 104–106 to form a rigging assembly. The remainder of the watercraft consists of pontoons and fittings as will be described below. Subsection 201*a* is a bow section and subsection 201*b* is a stem section of the overall pontoon 201. Sections 201*a* and 201*b* are each preferably an approximate ten foot piece of lightweight six inch PVC drain pipe fitted with a nose fairing 203 on each of the free ends of pontoons 201. The material employed for and size of pontoons 201 and fairings 203 may be altered in accordance with the desired application. Attachment pads 204 are affixed directly to sections 201*a* and 201*b*. Drain plugs 207 are positioned within drain apertures 207*a* to permit drainage of water which may enter within pontoons 201. Lightweight plugs 208 are hermetically adhered to the inside of pipes 201*a* and 201*b* such that each bow and stern section 201*a* and 201*b* include separate floatation chambers. The bell end 206*a* of bow section 201*a* is left intact and slides over the straight or spigot end 206*b* of stern section 201*b* during field assembly. A hole 209 is provided in bow section 201*a* to allow the escape of trapped air within the piping during field assembly. Each mounting pad 204 includes a handle 306 which may be fastened to mounting pad 204 or integrally formed therewith. Mounting pads 204 are preferably adhered to pontoons 201 by a strong adhesive, or the like. During assembly and transport, mounting pads 204, namely handles 306, facilitate the manipulation and carrying of pontoons 201.

Figure 3:
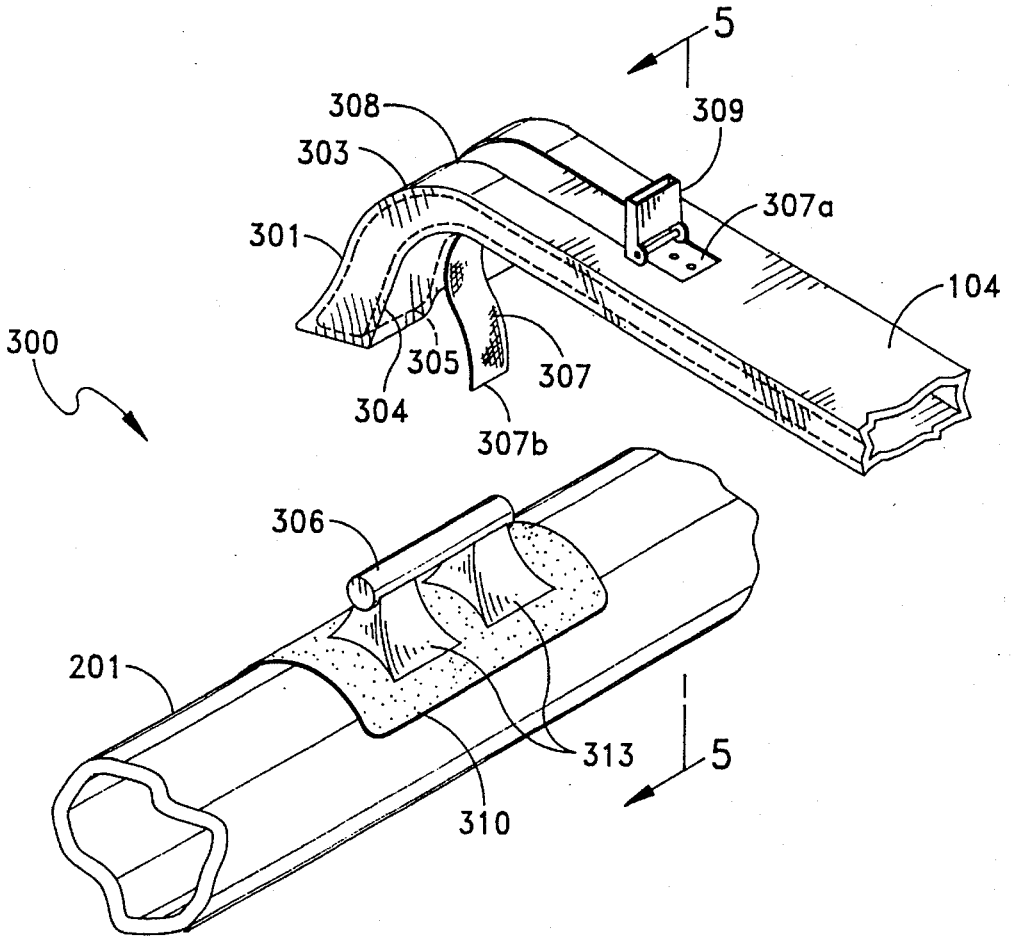
FIG. 3 is a perspective view of the improved pontoon connection, according to the present invention, in a disassembled condition.
Figure 4:
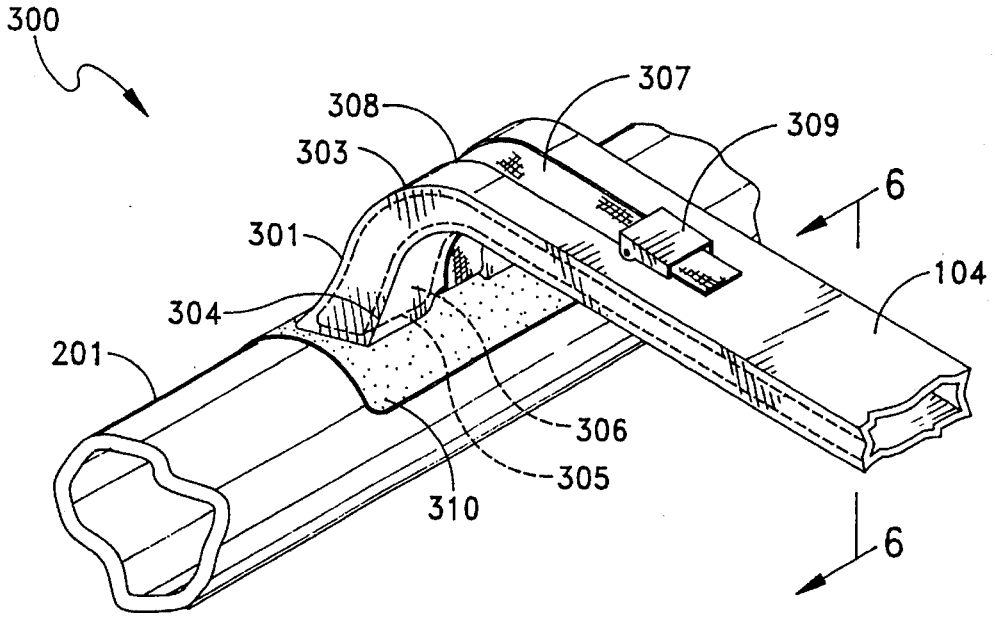
FIG. 4 is a perspective view of the improved pontoon connection, according to the present invention, in an assembled condition.
Figure 6:
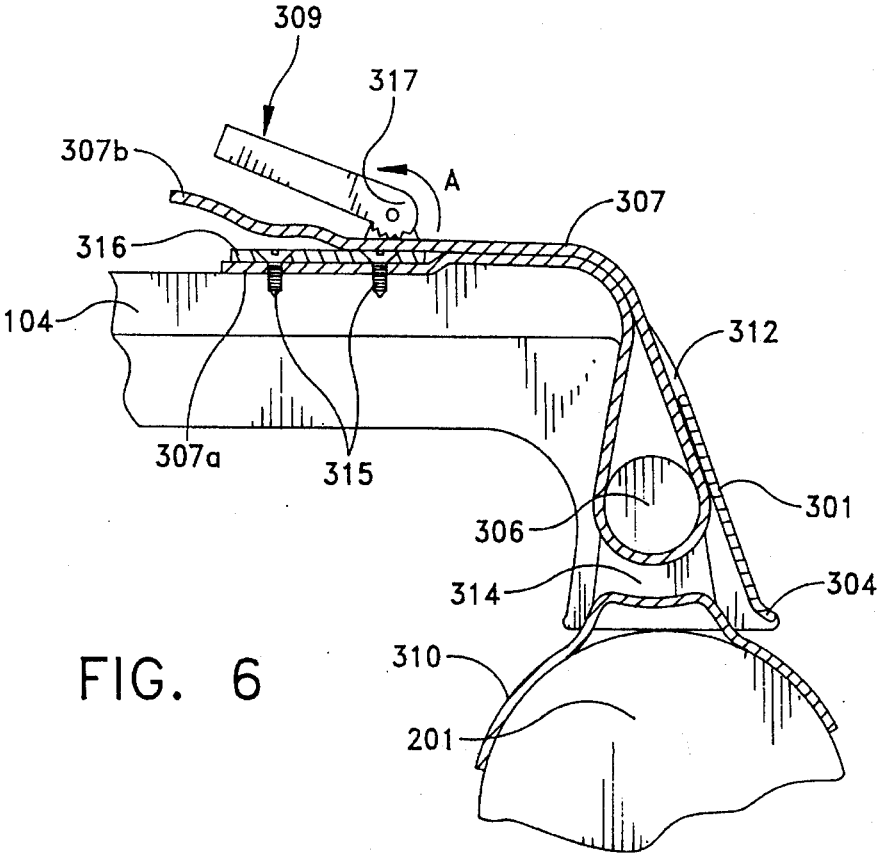
FIG. 6 is a cross-sectional view through the line 6—6 of FIG. 4.
Figure 7:
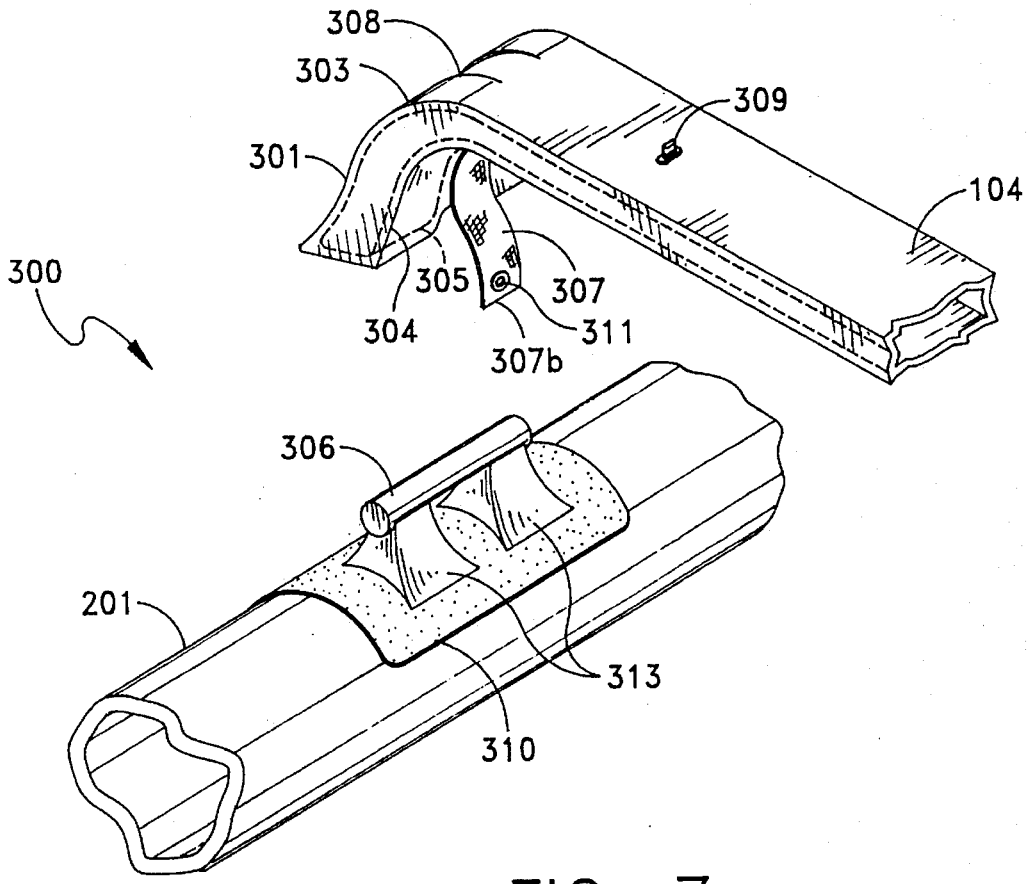
FIG. 7 is a perspective view of an alternative embodiment of the improved pontoon connection, in accordance with the present invention, in a disassembled condition.
Figure 8:
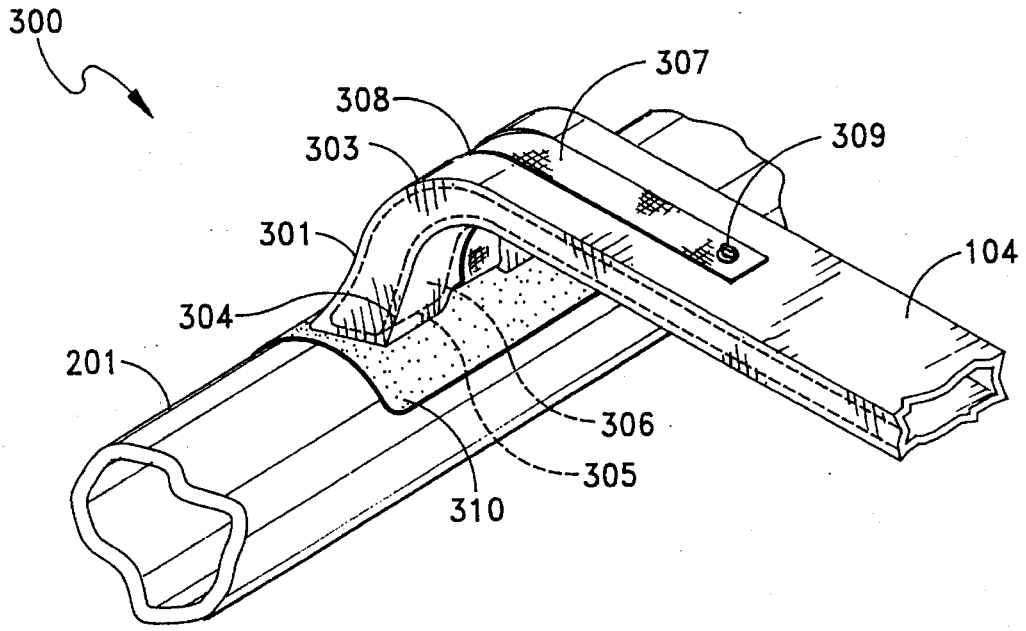
FIG. 8 is a perspective view of an alternative embodiment of the improved pontoon connection, in accordance with the present invention, in an assembled condition.

Turning now to FIGS. 3 and 4, details of the connection, generally referenced as 300, of cross-arms 104–106 to pontoons 201 is shown. A perspective view of the connection of a cross-arm to a pontoon 201 is shown in FIG. 3 prior to engagement. FIG. 4 illustrates a connected cross-arm to pontoon 201 in accordance with the present invention. Each cross-arm 104, for example, has a downward curvature 301 at its free ends 303 forming a nearly vertical portion including faired outer edges 304 aligned in the direction of the watercraft travel. A hollow receptacle 305 is provided within the downwardly curved ends 303 to provide a self-aligning socket to receive upwardly projecting handle 306. Receptacle 305 may be formed of two opposing walls of free end 303 or faired outer edges 304. Affixed to the upper portion of cross-arm 104 is flexible strap 307 which has an anchor end 307*a* and a free end 307*b*. Free end 307*b* is routed beneath cam-latch fastener 309 through strap aperture 312, which will be described in connection with FIGS. 5 and 6, underneath handle 306 and back through strap aperture 312 within alignment groove 308 and back through cam-latch fastener 309. Latch fastener 309 is preferably a cam-latch style but may be a twist-button latch, as shown in FIGS. 7 and 8, or an over-centered draw latch, or the like. It should be understood that various other types of latches may be employed to carry out the securement of the free end 307*b* of strap 307. Alignment groove 308 maintains strap 307 substantially aligned perpendicular to the length of pontoon 201, as shown in FIG. 4. Due to the strap 307*b* being flexible and capable of conforming to the outer surface of downwardly curved ends 303, precise strap alignment tolerance is not critical.

Figure 5:
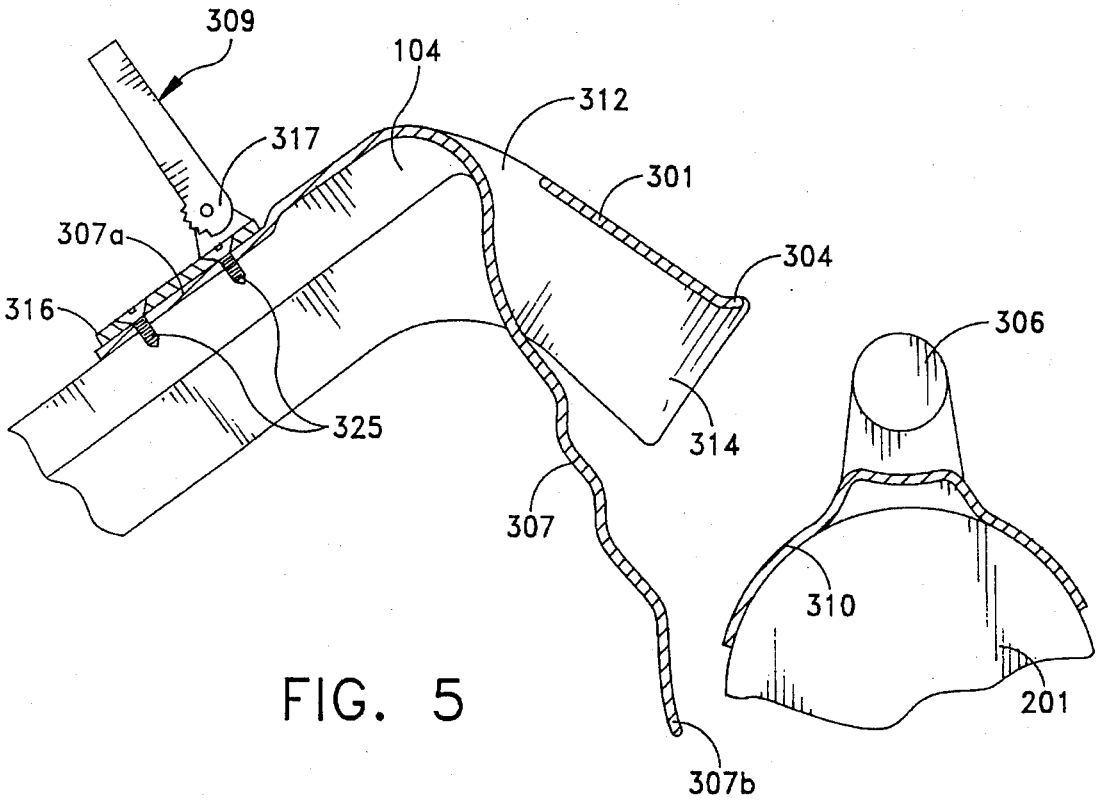
FIG. 5 is a cross-sectional view through the line 5—5 of FIG. 3.

Turning now to FIG. 5, a cross-sectional view through the line 5—5 of FIG. 3 is shown. FIG. 5 illustrates the positioning of a cross-arm 104 relative to pontoon 201 during the assembly process. Pontoon 201 carries attachment pad 310 which includes handle 306. Handle 306 is designed to reside within handle aperture 314 within the downwardly curved portion of cross-arm 104. Leading edge 304 is placed over handle 306 so handle 306 resides within handle aperture 314. As can be seen in FIG. 5, strap anchor portion 307*a* is secured to the top portion of cross-arm 104 by fasteners 325 through the base 316 of fastener 309 which includes ratchet portion 317. Free end 307*b* of strap 307 is routed through strap aperture 312. Referring now to FIG. 6, free end 307*b* is routed between handle 306 and attachment pad 310 and again up through strap aperture 312. Cross-arm 104 can then be positioned tightly against attachment pad 310 whereby free end 307*b* is routed through fastener 309, namely between ratchet 317 and base 316. Once the desired tension of strap 307 has been achieved, cam-latch fastener 309 is closed in the direction referenced "A" to secure strap 307. As a result, cross-arm 104 is releasably secured to pontoon 201 via attachment pad 310 and handle 306.

To disassemble the pontoon connection of the present invention, the cam-latch fastener 309 is released and the free end 307*b* of strap 307 is removed from the fastener to permit the overall strap 307 to be loosened. The strap is then permitted to unthread from underneath handle 306 and through strap aperture 312 thereby permitting separation of cross-arm 104 from pontoon 201. In view of the foregoing, cross-arm 104 may be quickly and easily connected and disconnected from pontoon 201 providing a fast, simple yet effective structure for securing the pontoon of the watercraft of the present invention.

Referring now to FIGS. 7 and 8, an alternative embodiment of the present invention is shown. Instead of employing a cam-latch fastener, fastener 309 is a twist-button style fastener for engagement with aperture 311 located at the free end 307*a* of strap 307. As can be seen in FIG. 8, twist-button 309 is turned after free end 307*a*, with aperture 311, is placed thereover.

Each of the components employed in the invention may be easily fabricated from plastic, fiberglass or any other marine suitable material. Most importantly, various components, such as the common PVC piping and fastener are readily available and are common items which thereby reduce the overall cost of the portable watercraft of the invention. Moreover, the size and dimensions of the components may be modified in accordance with the desired application of the portable watercraft of the present invention.

It would be appreciated by those skilled in the art that various changes and modifications can be made to the illustrated embodiments without departing from the spirit of the present invention. All such modifications and changes are intended to be covered by the appended claims.

What is claimed is:

1. A watercraft, comprising:

two elongated floatation members; said elongated floatation members being positioned substantially parallel to one another;

a plurality of mounting pads connected to said floatation members; each of said mounting pads including a handle;

a plurality of cross-arms spanning between said floatation members in substantially spaced and parallel relation to one another; each cross-arm including a central support region and two connector regions located at opposing sides thereof; said connector regions being tapered approximately 90 degrees relative to said central support region; said connector regions each including a handle aperture means for receiving and containing said handle;

a frame assembly positioned on said support regions of said cross-arms;

a seat slidably connected to said frame assembly;

a pair of oars pivotally connected to said frame assembly;

a strap having an anchor end and a free end; said anchor end of said strap being connected to said central support region of each cross-arm proximal to said connector regions;

fastener means for securing said free end of said strap in relation to said cross-arm; said fastener means being positioned on said central support region proximal said anchor end of said strap;

each of said connector regions including a strap aperture means for receiving said free end of said strap therethrough;

whereby said connector regions of said cross-arms are placed over said handles, respectively, for said handles to reside within said handle aperture means, respectively, and said free end of said strap is routed through said strap aperture means and underneath said handle and back through said strap aperture means to be secured in place by said fastener means to releasable secure each of said cross-arms to said floatation members.

2. The watercraft of claim 1, wherein said fastener means is a cam-latch.

3. The joint connection of claim 1, wherein said fastener means is a twist-button latch.

4. The watercraft of claim 1, wherein each of said connector regions include a strap guide channel means for aligning said strap after routing through said strap aperture; said strap guide means being positioned on said connector regions and between said strap apertures and said fastener means, respectively.

5. An improved releasable joint connection, comprising:

a mounting pad affixed to a support surface;

a handle connected to said mounting pad;

a hollow connector member having an open bottom end, a side wall and a closed top end;

a strap having a anchor end and a free end; said anchor end of said strap being connected to said top end;

fastener means for securing said free end of said strap relative to said closed top end;

said connector member having a strap aperture in said side wall; said hollow connector member positionable over said handle with said handle residing therein; said connector member including a strap aperture in said side wall; said strap aperture being capable of receiving said strap therethrough; said side wall including a strap guide channel means for aligning said strap after routing through said strap aperture; said strap channel guide means being positioned between said strap aperture and said fastener means; and whereby said free end of said strap is routed through said strap aperture and between said handle and said mounting pad and back through said strap aperture; said free end of said strap being secured to said top end by said fastener means to releasable secure said connector member to said mounting pad.

6. The joint connection of claim 5, wherein said fastener means is a cam-latch.

7. The joint of claim 5, wherein said fastener means is a twist-button latch.

* * * * *